US011428131B2

(12) United States Patent
Kemmerling et al.

(10) Patent No.: US 11,428,131 B2
(45) Date of Patent: Aug. 30, 2022

(54) EXHAUST-GAS AFTERTREATMENT ARRANGEMENT

(71) Applicant: Ford Global Technologies, LLC, Dearborn, MI (US)

(72) Inventors: Joerg Kemmerling, Monschau (DE); Frank Wunderlich, Herzogenrath (DE); Michael Forsting, Moenchengladbach (DE); Vanco Smiljanovski, Bedburg (DE); Hanno Friederichs, Aachen (DE); Helmut Matthias Kindl, Aachen (DE); Andreas Kuske, Geulle (NL); Arnd Sommerhoff, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 1 day.

(21) Appl. No.: 17/110,151

(22) Filed: Dec. 2, 2020

(65) Prior Publication Data

US 2021/0199033 A1 Jul. 1, 2021

(51) Int. Cl.

| | |
|---|---|
| ***F01N 1/02*** | (2006.01) |
| ***F01N 1/16*** | (2006.01) |
| ***F01N 3/035*** | (2006.01) |

(52) U.S. Cl.

CPC ..... *F01N 1/02* (2013.01); *F01N 1/163* (2013.01); *F01N 3/035* (2013.01); *F01N 2250/02* (2013.01); *F01N 2900/08* (2013.01)

(58) Field of Classification Search

CPC ... F01N 1/02; F01N 1/12; F01N 1/163; F01N 2290/10; F01N 3/035

USPC ..... 181/249

See application file for complete search history.

(56) References Cited

U.S. PATENT DOCUMENTS

| | | | | |
|---|---|---|---|---|
| 4,107,921 | A * | 8/1978 | Iizuka | F02D 41/1443 60/288 |
| 5,703,336 | A * | 12/1997 | Tark | F01N 1/12 181/403 |
| 6,494,290 | B1 * | 12/2002 | Jessberger | G10K 11/172 181/219 |
| 8,726,640 | B2 * | 5/2014 | Tilinski | F01N 3/2892 60/303 |
| 9,593,612 | B2 | 3/2017 | Takatsu et al. | |
| 9,976,460 | B2 | 5/2018 | Khan | |
| 2010/0001535 | A1 | 1/2010 | Kimura et al. | |
| 2010/0024399 | A1 * | 2/2010 | Demura | F02B 37/02 60/299 |
| 2013/0111901 | A1 * | 5/2013 | Leone | F02M 35/10295 60/611 |
| 2015/0322848 | A1 * | 11/2015 | Gokhale | F01N 3/2053 60/602 |

FOREIGN PATENT DOCUMENTS

| | | | | |
|---|---|---|---|---|
| DE | 102009020625 | A1 * | 11/2010 | F02B 37/02 |
| DE | 202018107439 | A1 | 1/2019 | |
| EP | 2759686 | B1 * | 9/2018 | F01N 11/002 |
| SU | 1751369 | A1 | 7/1992 | |
| WO | 2008034943 | A1 | 3/2008 | |

* cited by examiner

*Primary Examiner* — Jason D Shanske

(74) *Attorney, Agent, or Firm* — Vincent Mastrogiacomo; McCoy Russell LLP

(57) ABSTRACT

Methods and systems are provided for a resonator of an exhaust system. In one example, the resonator is a quarter wave resonator with a diaphragm configured to provide pulsations during low-end engine torque conditions.

18 Claims, 3 Drawing Sheets

EXHAUST-GAS AFTERTREATMENT ARRANGEMENT

CROSS-REFERENCE TO RELATED APPLICATIONS

The present application claims priority to German Patent Application No. 102019008357.1 filed on Dec. 2, 2019. The entire contents of the above-listed application is hereby incorporated by reference for all purposes.

FIELD

The present description relates generally to a supercharged engine having an exhaust-gas aftertreatment arrangement.

BACKGROUND/SUMMARY

Resonance may occur in exhaust systems of a vehicle due to a flow of an exhaust gas depending on a dimension and/or a configuration of a catalyst purifying the exhaust gas. Additionally, a shape of an exhaust gas pipe extending from an engine to the catalyst may further dictate resonance occurrence.

One example of addressing resonance includes adjusting a geometry of the exhaust passage to reduce resonance. One example approach is shown by Takatsu et al. Therein, a protuberance is introduced into an exhaust passage upstream of a catalyst to decrease the occurrence of resonance.

However, the inventors have identified some issues with the approaches described above. For example, in some vehicles arrangements, if the catalyst is arranged upstream of the turbine, then pulsations at the turbine are reduced, which may result in turbo lag during low-end torque engine conditions. As such, there may be conditions where pulsations are desired.

In one example, the issues described above may be addressed by an exhaust system comprising a turbine downstream of one or more aftertreatment devices relative to a direction of exhaust gas flow and a resonator system coupled to the exhaust system upstream of the one or more aftertreatment devices at a first junction and downstream of the one or more aftertreatment devices at a second junction. In this way, the resonator system may provide desired pulse amplifications to the turbine.

As one example, the resonator system is configured to provide exhaust gas pressure pulses to a turbine arranged downstream of a close coupled exhaust gas aftertreatment system. The resonator system comprises a gas tight membrane which is exposed to exhaust gases upstream of the aftertreatment system. A quarter wave tube is coupled to an opposite side of the membrane and to a portion of the exhaust system downstream of the aftertreatment system and upstream of the turbine. The membrane may be excited via pressure pulses from the exhaust gas that provide a frequency corresponding to a certain engine order. Gas back flowed within the quarter wave tube is excited by the membrane and creates a pressure pulse upstream of the turbine at the open end of the quarter wave tube opposite the membrane.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
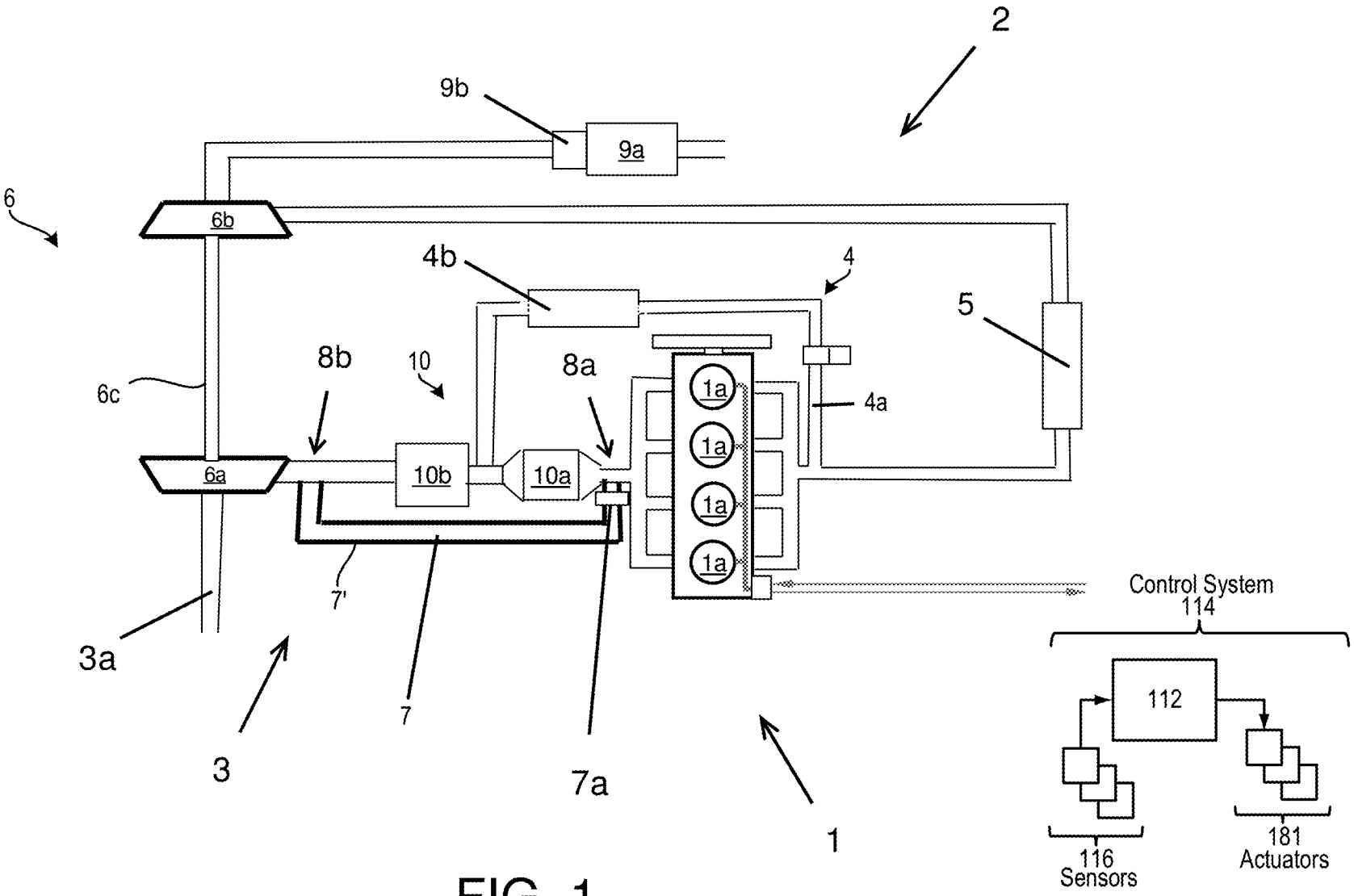
FIG. 1 schematically shows a first embodiment of the supercharged internal combustion engine.
Figure 2:
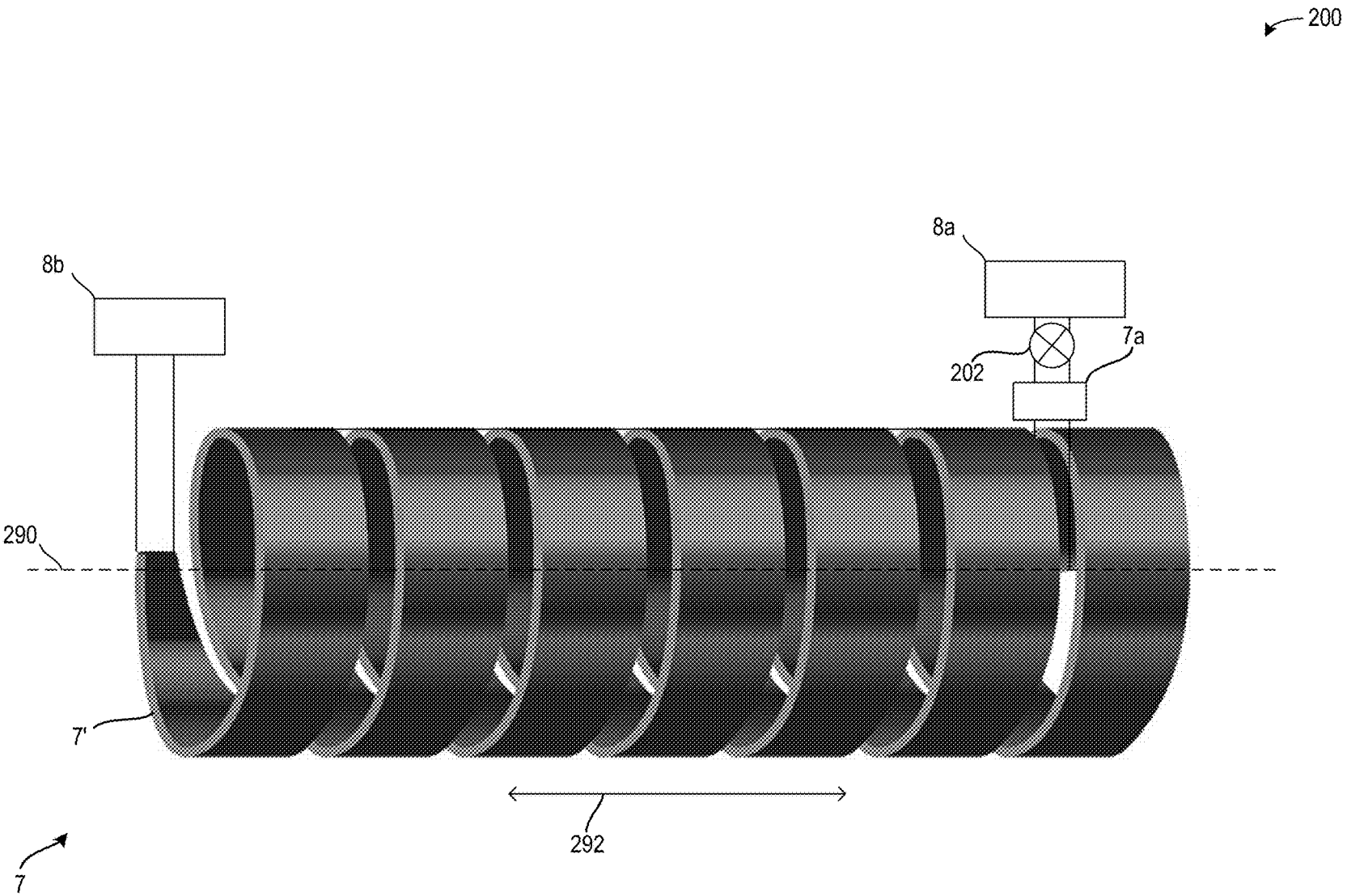
FIG. 2 shows an embodiment of a resonator system.
Figure 3:
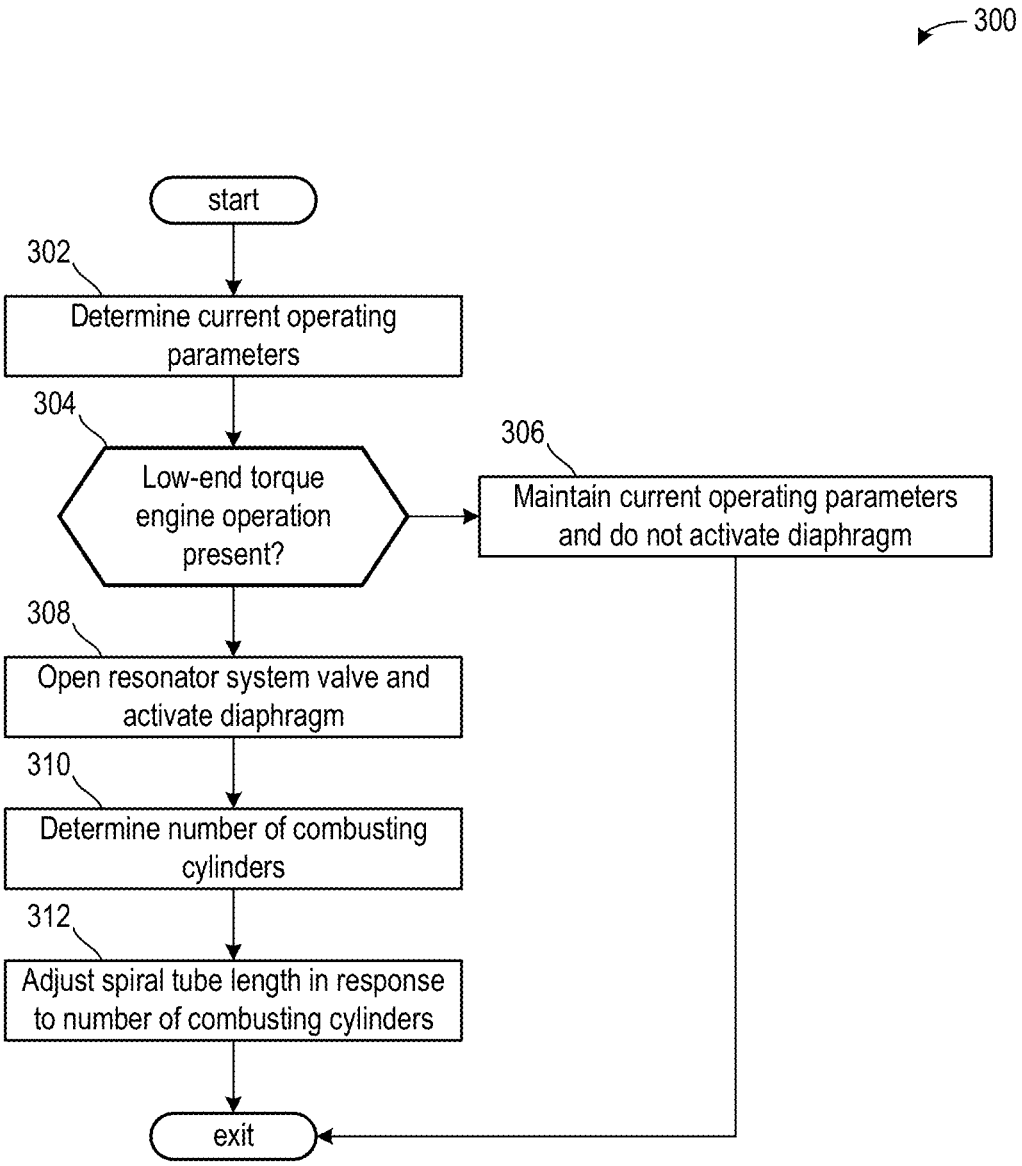
FIG. 3 shows a method of operating the resonator system.

The following description relates to systems and methods for a resonator system. FIG. 1 schematically shows a first embodiment of the supercharged internal combustion engine. FIG. 2 shows an embodiment of a resonator system. FIG. 3 shows a method of operating the resonator system.

An internal combustion engine of the type mentioned in the introduction is used for example as a motor vehicle drive unit. Within the context of the present disclosure, the expression "internal combustion engine" encompasses diesel engines and Otto-cycle engines but also hybrid internal combustion engines, which utilize a hybrid combustion process, and hybrid drives which comprise not only an internal combustion engine but also an electric machine which can be connected in terms of drive to the internal combustion engine and which receives power from the internal combustion engine or which, as a switchable auxiliary drive, additionally outputs power.

Supercharging of an internal combustion engine serves primarily for increasing power. The air desired for the combustion process is compressed, as a result of which a greater air mass can be supplied to each cylinder per working cycle. In this way, the fuel mass and therefore the mean pressure can be increased.

Supercharging may be configured to increase the power of an internal combustion engine while maintaining an unchanged swept volume, or for reducing the swept volume while maintaining the same power. In all cases, supercharging leads to an increase in volumetric power output and a more expedient power-to-weight ratio. If the swept volume is reduced, it is possible to shift the load collective toward higher loads, at which the specific fuel consumption is lower. By means of supercharging in combination with a suitable transmission configuration, it is also possible to realize so-called downspeeding, with which it is likewise possible to achieve a lower specific fuel consumption.

Supercharging consequently assists in the constant efforts in the development of internal combustion engines to minimize fuel consumption, that is to say to improve the efficiency of the internal combustion engine.

For supercharging, use is generally made of an exhaust-gas turbocharger, in which a compressor and a turbine are arranged on the same shaft. The hot exhaust-gas flow is supplied to the turbine and expands in said turbine with a release of energy, as a result of which the shaft is set in rotation. The energy released by the exhaust-gas flow to the turbine and ultimately to the shaft is used for driving the compressor, which is likewise arranged on the shaft. The compressor conveys and compresses the charge air fed to it, as a result of which supercharging of the cylinders is realized. A charge-air cooling arrangement may additionally be provided, via which the compressed charge air is cooled before it enters the cylinders.

The advantage of an exhaust-gas turbocharger for example in comparison with a mechanical charger is that no mechanical connection for transmitting power exists or is desired between the charger and internal combustion engine. Such a mechanical connection takes up additional structural space in the engine bay and has an influence on the arrangement of the assemblies. While a mechanical charger extracts the energy desired for driving it entirely from the internal combustion engine, and thereby reduces the output power and consequently adversely affects the efficiency, the exhaust-gas turbocharger utilizes the exhaust-gas energy of the hot exhaust gases.

The internal combustion engine to which the present disclosure relates also has at least one exhaust-gas turbocharger.

Problems are encountered in the configuration of the exhaust-gas turbocharging, wherein it is basically sought to obtain a noticeable performance increase in all engine speed ranges. In the case of internal combustion engines supercharged by way of an exhaust-gas turbocharger, a noticeable torque drop is observed when a certain engine speed is undershot. This effect is undesirable.

Said torque drop is understandable considering that the charge pressure ratio is dependent on the turbine pressure ratio. For example, if the engine speed is reduced, this leads to a smaller exhaust-gas flow and therefore to a lower turbine pressure ratio. This has the effect that, toward lower rotational speeds, the charge pressure ratio likewise decreases, which equates to a torque drop.

In the previous examples, it is sought, using a variety of measures, to improve the torque characteristic of an exhaust-gas-turbocharged internal combustion engine.

One such measure, for example, is a small design of the turbine cross section and provision of an exhaust-gas blow-off facility. Such a turbine is also referred to as a wastegate turbine. If the exhaust-gas mass flow exceeds a threshold value, a part of the exhaust-gas flow is, within the course of a so-called exhaust-gas blow-off, conducted via a bypass line past the turbine. Said approach however has the disadvantage that the supercharging behavior is insufficient at relatively high engine speeds.

The torque characteristic of a supercharged internal combustion engine may furthermore be improved via multiple turbochargers arranged in parallel, that is to say via multiple turbines of relatively small turbine cross section arranged in parallel, wherein turbines are activated successively with increasing exhaust-gas flow rate, similarly to sequential supercharging.

The torque characteristic may also be advantageously influenced via multiple exhaust-gas turbochargers connected in series. By connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows.

With regard to the configuration of the exhaust-gas turbocharging, it is sought to arrange the turbine or turbines as close as possible to the outlet of the internal combustion engine, that is to say close to the outlet openings of the cylinders, in order thereby to be able to make optimum use of the exhaust-gas enthalpy of the hot exhaust gases, which is determined significantly by the exhaust-gas pressure and the exhaust-gas temperature, and to ensure a fast response behavior of the turbocharger. A close-coupled arrangement not only shortens the path of the hot exhaust gases to the turbine but also reduces the volume of the exhaust-gas discharge system upstream of the turbine. The thermal inertia of the exhaust-gas discharge system likewise decreases, specifically owing to a reduction in the mass and length of the part of the exhaust-gas discharge system leading to the turbine. For the reasons stated above, the turbines are generally arranged on the cylinder head at the outlet side. For the same reasons, according to the previous examples, the exhaust manifold is commonly integrated in the cylinder head. The integration of the exhaust manifold additionally permits dense packaging of the drive unit. Furthermore, the exhaust manifold can benefit from a liquid-type cooling arrangement that may be provided in the cylinder head, such that the manifold does not demand to be manufactured from materials that can be subjected to high thermal load, which are expensive.

In the case of supercharged internal combustion engines in which at least one turbine of an exhaust-gas turbocharger is provided in the exhaust-gas discharge system and which are intended to exhibit satisfactory operating behavior, in particular a satisfactory torque characteristic, in the lower engine speed and/or load range, that is to say in the case of relatively low exhaust-gas flow rates, so-called pulse supercharging is desired.

Here, it is the intention for the dynamic wave phenomena occurring in the exhaust-gas discharge system—in particular during the charge exchange—to be utilized for the purposes of supercharging and for improving the operating behavior of the internal combustion engine.

The evacuation of the combustion gases out of a cylinder of the internal combustion engine during the charge exchange is based substantially on two different mechanisms. When the outlet valve opens close to bottom dead center at the start of the charge exchange, the combustion gases flow at high speed through the outlet opening into the exhaust-gas discharge system on account of the high pressure level prevailing in the cylinder toward the end of the combustion and the associated high pressure difference between combustion chamber and exhaust line. Said pressure-driven flow process is assisted by a high pressure peak which is also referred to as a pre-outlet shock and which propagates along the exhaust line at the speed of sound, with the pressure being dissipated, that is to say reduced, to a greater or lesser extent with increasing distance traveled as a result of friction.

During the further course of the charge exchange, the pressures in the cylinder and in the exhaust line are equalized, such that the combustion gases are no longer evacuated primarily in a pressure-driven manner but rather are expelled as a result of the stroke movement of the piston.

At low loads or engine speeds, that is to say low exhaust-gas flow rates, the pre-outlet shock can advantageously be utilized for pulse supercharging, whereby it is possible to obtain high turbine pressure ratios even at low turbine rotational speeds. In this way, it is possible via exhaust-gas turbocharging to generate high charge-pressure ratios, that is to say high charge pressures on the inlet side, even in the case of only low exhaust-gas flow rates, that is to say at low loads and/or low engine speeds.

Pulse supercharging has proven to be desired for accelerating the turbine rotor, that is to say for increasing the turbine rotational speed, which can fall to a noticeable extent during idle operation of the internal combustion engine or at low load, and which may frequently be increased again with as little delay as possible via the exhaust-gas flow in the event of an increased load demand. The inertia of the rotor and the friction in the shaft bearing arrangement generally slow an acceleration of the rotor to higher rotational speeds and therefore hinder an immediate rise in the charge pressure.

To be able to utilize the dynamic wave phenomena occurring in the exhaust-gas discharge system, in particular the pre-outlet shocks, for the pulse supercharging for improving the operating behavior of the internal combustion engine, the pressure peaks or pre-outlet shocks in the exhaust-gas discharge system may be obtained. It is desired if the pressure fluctuations in the exhaust lines are intensified, but at least do not attenuate one another or cancel one another out.

Pulse supercharging however also has disadvantages. For example, the charge exchange is generally impaired as a result of the pressure fluctuations in the exhaust-gas discharge system. It may also be taken into consideration that a turbine is operated most effectively under steady-state engine operating conditions. To enable a turbine which is provided downstream of the cylinders in the exhaust-gas discharge system to be operated optimally at high loads and high rotational speeds, that is to say at high exhaust-gas flow rates, the turbine may be acted on with as constant an exhaust-gas flow as possible, for which reason a pressure which varies as little as possible is desired upstream of the turbine under said operating conditions in order to realize so-called ram supercharging.

Exhaust-gas turbocharging in combination with exhaust-gas aftertreatment has shown some issues.

According to the previous example, to reduce the pollutant emissions, internal combustion engines are equipped with various exhaust-gas aftertreatment systems.

In Otto-cycle engines, catalytic reactors may be used through the use of catalytic materials which increase the rate of certain reactions and ensure an oxidation of HC and CO even at low temperatures. If nitrogen oxides (NOx) are additionally to be reduced, this can be achieved by the use of a three-way catalytic converter, which however for this purpose may demand stoichiometric operation ($\lambda \approx 1$) of the Otto-cycle engine within narrow limits.

Despite catalytic assistance, oxidation catalytic converters and three-way catalytic converters may demand a certain minimum temperature or light-off temperature in order to realize adequately high conversion rates, which temperature may for example range from 120° C. to 250° C.

In the case of internal combustion engines which are operated with an excess of air, that is to say for example applied-ignition engines which operate in the lean-burn mode, but in particular direct-injection diesel engines or else direct-injection applied-ignition engines, the nitrogen oxides contained in the exhaust gas may not be reduced owing to the operating principle, that is to say owing to the lack of reducing agent.

For the oxidation of the unburned hydrocarbons and of carbon monoxide, an oxidation catalytic converter is provided in the exhaust-gas discharge system. To reduce the nitrogen oxides, use is made inter alia of selective catalytic converters—so-called SCR catalytic converters—in which reducing agent is purposely introduced into the exhaust gas in order to selectively reduce the nitrogen oxides. As reducing agent, in addition to ammonia and urea, use may also be made of unburned hydrocarbons.

It is also possible to reduce the nitrogen oxide emissions via so-called nitrogen oxide storage catalytic converters (LNT). Here, the nitrogen oxides are initially, during lean-burn operation of the internal combustion engine, absorbed, that is to say collected and stored, in the catalytic converter in order to be reduced during a regeneration phase for example via substoichiometric operation ($\lambda<1$) of the internal combustion engine with a deficit of oxygen, wherein the unburned hydrocarbons serve as reducing agent.

The frequency of the regeneration phases is determined by the overall emission of nitrogen oxides and the storage capacity of the storage catalytic converter. The temperature of the storage catalytic converter may lie in a temperature window between 200° C. and 450° C., such that firstly a fast reduction is ensured and secondly no desorption without conversion of the re-released nitrogen oxides takes place, such as may be triggered by excessively high temperatures.

One difficulty in the use of a storage catalytic converter arises from the sulfur contained in the exhaust gas, which sulfur is likewise absorbed in the storage catalytic converter and may be regularly removed via a desulfurization. For this purpose, the storage catalytic converter may be heated to high temperatures, usually of between 600° C. and 700° C., and supplied with a reducing agent, which in turn can be attained by the transition to rich operation of the internal combustion engine.

According to previous examples, to minimize the emission of soot particles, use is made of so-called regenerative particle filters which filter the soot particles out of the exhaust gas and store them, with said soot particles being burned off intermittently during the course of the regeneration of the filter. For this purpose, in order to oxidize the soot in the filter, oxygen or an excess of air is desired in the exhaust gas, which can be achieved for example by way of superstoichiometric operation ($\lambda>1$) of the internal combustion engine.

The high temperatures for the regeneration of the particle filter, of approximately 550° C. without catalytic assistance, can be attained only with difficulty during operation.

The above statements show that exhaust-gas aftertreatment systems for the conversion of pollutants may demand a certain operating temperature, for which reason measures may be implemented in order to generate and maintain the desired temperatures. Furthermore, it may be ensured that the exhaust-gas aftertreatment systems are heated up as rapidly as possible, and reach their operating temperature quickly, after a cold start, after a restart or during the warm-up phase.

In order to adhere to future limit values for pollutant emissions, a close-coupled arrangement of the exhaust-gas aftertreatment systems would be expedient.

A close-coupled arrangement of the exhaust-gas aftertreatment systems however leads to conflicts in the presence of an exhaust-gas turbocharging arrangement. If exhaust-gas aftertreatment is performed upstream of the turbine of an exhaust-gas turbocharger, the supercharging behavior and consequently the torque characteristic of the internal combustion engine are considerably impaired, in particular at low engine speeds and relatively low loads, because the dynamic wave phenomena occurring in the exhaust-gas discharge system can no longer be utilized for the pulse supercharging. The pressure oscillations or pressure waves in the exhaust-gas system are attenuated or eliminated by the exhaust-gas aftertreatment systems that are provided.

Against this background, it is the object of the present disclosure to provide a supercharged internal combustion engine with which the dynamic wave phenomena occurring in the exhaust-gas discharge system can be utilized for the purposes of pulse supercharging and thus to improve the operating behavior of the internal combustion engine.

Said object is achieved via a supercharged internal combustion engine having an intake system for the supply of charge air and having an exhaust-gas discharge system for the discharge of exhaust gas and having at least one exhaust-gas turbocharger which comprises a turbine arranged in the exhaust-gas discharge system and a compressor arranged in the intake system, wherein at least one exhaust-gas aftertreatment system for the aftertreatment of the exhaust gas is arranged in the exhaust-gas discharge system upstream of the turbine, and which internal combustion engine is distinguished by the fact that an additional line is provided which branches off from the exhaust-gas discharge system, forming a first junction, upstream of the at least one exhaust-gas aftertreatment system and which opens into the exhaust-gas discharge system again, forming a second junction, between the at least one exhaust-gas aftertreatment system and the turbine and in which a gas-impermeable diaphragm is arranged for the purposes of transmitting the pressure oscillations.

The internal combustion engine according to the disclosure is equipped with a device via which the pressure waves or pressure oscillations originating from the outlet openings of the cylinders and propagating in the exhaust-gas discharge system can be transmitted in a manner circumventing the exhaust-gas aftertreatment arrangement, and are available downstream of the exhaust-gas aftertreatment arrangement, and upstream of the turbine, for the purposes of pulse supercharging.

Said device comprises an additional line which branches off from the exhaust-gas discharge system, forming a first junction, upstream of the at least one exhaust-gas aftertreatment system and which opens into the exhaust-gas discharge system again, forming a second junction, between the at least one exhaust-gas aftertreatment system and the turbine. The additional line has a diaphragm which serves for the transmission of the pressure oscillation. The diaphragm is impermeable to gas in order to block exhaust gas that has not been purified from bypassing the exhaust-gas aftertreatment arrangement via the additional line and passing untreated into the surroundings. Since the diaphragm is acted on by the hot exhaust gases, it may be resistant to high temperatures. The air column situated, at the side of the second junction, in the additional line downstream of the diaphragm is stimulated, or set in oscillation, by the oscillating diaphragm if the diaphragm itself, at the side of the first junction, is set in oscillation by the pressure waves originating from the cylinders.

According to the disclosure, the fact that the pressure waves originating from the cylinders are attenuated or eliminated by the exhaust-gas aftertreatment systems arranged in the exhaust-gas discharge system circumvented via the arrangement of the resonator system.

With the internal combustion engine according to the disclosure, the first object on which the disclosure is based is achieved, that is to say a supercharged internal combustion engine includes the dynamic wave phenomena occurring in the exhaust-gas discharge system can be utilized for the purposes of pulse supercharging and thus to improve the operating behavior of the internal combustion engine.

Embodiments of the supercharged internal combustion engine may comprise where a shut-off element is arranged in the additional line.

The shut-off element serves for the activation and deactivation of the device for transmitting the pressure oscillations, wherein an activation is performed by opening the shut-off element and a deactivation is performed by closing the shut-off element.

An activation of the device may be desired at low engine speeds (e.g., engine speeds less than a threshold speed) or at low loads (e.g., engine loads less than a threshold load) in order to be able to realize pulse supercharging by transmission of the pressure oscillations via the additional line. By contrast, if ram supercharging is desired, a deactivation may be initiated.

In this context, embodiments of the supercharged internal combustion engine may comprise where the shut-off element is arranged upstream of the gas-impermeable diaphragm.

If the shut-off element is arranged upstream of the gas-impermeable diaphragm, the diaphragm is not continuously acted on by hot exhaust gases and is not continuously stimulated to oscillate owing to the dynamic wave phenomena in the exhaust-gas discharge system. Both of these factors increase the durability of the diaphragm, which may be deformable or elastic in order to transmit the pressure oscillations. It is also possible for deposits on or at the diaphragm to be reduced in this way.

Embodiments of the supercharged internal combustion engine may comprise where the gas-impermeable diaphragm is arranged close to the first junction.

The additional line is divided by the diaphragm into two sections, specifically a first section between the gas-impermeable diaphragm and the first junction, and a second section between the gas-impermeable diaphragm and the second junction. For the concept according to the disclosure of the transmission of pressure oscillations, the second section, specifically the length of said second section, is of relevance. The first section, which conducts the exhaust gas originating from the cylinders to the diaphragm, may basically be designed to be as short as possible in order to minimize the structural space taken up by the device. The length of the first section may be configured differently without affecting the functioning of the device, and has minimal influence on the transmission of the pressure oscillations. In one example, the first section is sized as small as possible while being large enough to house the shut-off element and the diaphragm.

Embodiments of the supercharged internal combustion engine may comprise where, for the aftertreatment of the exhaust gas, an oxidation catalytic converter as exhaust-gas aftertreatment system is provided in the exhaust-gas discharge system.

Embodiments of the supercharged internal combustion engine may comprise where, for the aftertreatment of the exhaust gas, a particle filter as exhaust-gas aftertreatment system is provided in the exhaust-gas discharge system.

Embodiments of the supercharged internal combustion engine may comprise where, for the aftertreatment of the exhaust gas, a storage catalytic converter as exhaust-gas aftertreatment system for the reduction of nitrogen oxides is provided in the exhaust-gas discharge system.

Embodiments of the supercharged internal combustion engine may comprise where the additional line is of spiral-shaped form at least in certain sections. The line, or its relevant second section, may in individual cases be of one meter, two meters or more in length.

In order to realize as compact a design as possible, which takes up as little structural space as possible, it may be desired for the line to be of spiral-shaped form at least in certain sections. A spiral-shaped design of the line may be desired from a flow aspect, because the pressure losses resulting from friction are low.

Embodiments of the supercharged internal combustion engine may comprise where a section of the additional line, which section extends between the gas-impermeable diaphragm and the second junction, is adjustable in terms of its length.

A second section which is adjustable in terms of length permits the adaptation of the length to the present engine speed. In this context, it may be taken into consideration that the length of the section at which the air column situated in said section resonates is dependent on the engine rotational speed. Other parameters also have an influence, for example the number of cylinders and the operating process used, that is to say a four-stroke operating process or two-stroke operating process.

If the second section of the additional line is adjustable in terms of its length, the torque characteristic can be improved not only at a specific engine speed but rather over an engine speed band or engine speed range of greater or lesser breadth, because an adaptation of the length is possible.

In this context, embodiments of the supercharged internal combustion engine may comprise where the section of the additional line is of modular construction and comprises at least two elements, wherein at least two elements are movable relative to one another.

Here, embodiments of the supercharged internal combustion engine may comprise where at least two elements are displaceable relative to one another in telescopic fashion.

Here, embodiments of the supercharged internal combustion engine may comprise where at least two elements are rotatable relative to one another about a common axis of rotation. This embodiment is expedient if the additional line is of spiral-shaped form at least in certain sections. Then, the likewise spiral-shaped elements are displaced partially one inside the other during the relative rotation.

Embodiments of the supercharged internal combustion engine may comprise where a section of the additional line which extends between the gas-impermeable diaphragm and the second junction is configured and adapted in terms of its length such that a gas column that oscillates in said section resonates at a predefinable engine rotational speed nmot, resonance, wherein the following applies: 1000 rpm<nmot, resonance<2000 rpm.

In this context, embodiments of the supercharged internal combustion engine may comprise where, for the predefinable engine rotational speed nmot,resonance, the following applies: 1100 rpm<nmot,resonance<1800 rpm.

In this context, embodiments of the supercharged internal combustion engine may comprise where for the predefinable engine rotational speed nmot,resonance, the following applies: 1100 rpm<nmot,resonance<1600 rpm.

In this context, embodiments of the supercharged internal combustion engine may comprise where, for the predefinable engine rotational speed nmot,resonance, the following applies: 1100 rpm<nmot,resonance<1500 rpm.

Turning now to FIG. 1, it shows a first embodiment of the supercharged internal combustion engine 1, based on the example of a four-cylinder in-line engine. The four cylinders 1*a* of the internal combustion engine 1 may be arranged in a line along a longitudinal axis of the cylinder head. Additionally or alternatively, the cylinders may include a different number and/or a different configuration (e.g., V6). The exhaust lines of the cylinders 1*a* merge to form an overall exhaust line 3*a*, whereby all of the exhaust lines form a common exhaust-gas discharge system 3 and are connected to one another, and the same exhaust-gas pressure prevails in all exhaust lines. Furthermore, the internal combustion engine 1 has an intake system 2 for the supply of charge air to the cylinders 1*a*.

For the supercharging of the cylinders 1*a*, an exhaust-gas turbocharger 6 is provided which comprises a turbine 6*a* arranged in the exhaust-gas discharge system 3 and a compressor 6*b* arranged in the intake system 2, which turbine and compressor have a common shaft 6*c*.

Upstream of the compressor 6*b*, an air filter 9*a* is arranged in the intake system 2, which filter purifies the air drawn in via the intake system 2, along with an air mass sensor 9*b*, which detects the overall air flow rate supplied to the cylinders 1*a* of the internal combustion engine 1.

Downstream of the compressor 6*b*, relative to a direction of intake air flow, a charge-air cooler 5 is provided in the intake system 2 in order to cool the compressed charge air before it enters the cylinders 1*a*.

Upstream of the turbine 6*a*, relative to a direction of exhaust gas flow, there are arranged two exhaust-gas aftertreatment systems 10 for the aftertreatment of the exhaust gas, specifically an oxidation catalytic converter 10*a* and a particle filter 10*b*, wherein the oxidation catalytic converter 10*a* is arranged upstream of the particle filter 10*b*.

An exhaust-gas recirculation arrangement 4 permits the recirculation of hot exhaust gases from the exhaust-gas discharge system 3 into the intake system 2, wherein the recirculation line 4*a* branches off from the exhaust-gas discharge system 3 between the oxidation catalytic converter 10*a* and the particle filter 10*b* and opens into the intake system 2 again downstream of the charge-air cooler 5. The exhaust-gas recirculation arrangement 4 is consequently a high-pressure EGR arrangement 4. A cooler 4*b* for cooling the hot exhaust gases is provided in the recirculation line 4*a*. An exhaust-gas recirculation valve 4*c* is arranged downstream of the cooler 4*b* and is configured to adjust exhaust gas flow to the intake system 2.

An additional line 7 branches off from the exhaust-gas discharge system 3, forming a first junction 8*a*, upstream of the exhaust-gas aftertreatment systems 10*a*, 10*b* and opens into the exhaust-gas discharge system 3 again, forming a second junction 8*b*, between the two exhaust-gas aftertreatment systems 10*a*, 10*b* and the turbine 6*a*. More specifically, the first junction 8*a* is arranged upstream of the oxidation catalytic converter 10*a*, between it and the engine 1. The second junction is arranged downstream of the particle filter 10*b*, between it and the turbine 6*a*.

Said additional line 7 belongs to a device for transmitting pressure oscillations. A diaphragm 7*a* is arranged in the line 7 closer to the first junction 8*a* than the second junction 8*b*. The diaphragm 7*a* is impermeable to gas and blocks exhaust gas that has not been purified from passing into the surroundings. A section 7' may be configured for the transmission of the pressure oscillations, the section 7' which extends between the diaphragm 7*a* and the second junction 8*b*.

The air column that is situated in said section 7' of the additional line 7—at the side of the second junction 8*b* downstream of the diaphragm 7*a*—is set in oscillation by the diaphragm 7*a* if the diaphragm 7*a* itself is, at the side of the first junction 8*a*, set in oscillation by the pressure waves originating from the cylinders 1*a*.

Upstream of the diaphragm 7*a*, a shut-off element is arranged in the additional line 7.

Control system 114 is shown receiving information from a plurality of sensors 116 and sending control signals to a plurality of actuators 181 (including an actuator for a shut-off element of the resonator system and an actuator for a spiral tube of the resonator system). As one example, sensors 116 may include an engine speed sensor, an engine load sensor, and the like. Other sensors such as additional pressure, temperature, air/fuel ratio, and composition sensors may be coupled to various locations in the vehicle system.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In one example, if there are four cylinders in an engine, such as in the example of FIG. 1, then a pressure pulse excitation of the four cylinders is according to a $2^{nd}$ engine order (e.g., two exhaust events per engine revolution). A $2^{nd}$ order frequency at 1400 rpm, which may correspond to an engine speed at low-end torque engine operation, may include an excitation frequency of exhaust gas pulses from the engine at approximately 46.7 Hz. As such, a desired section tube length may be equal to 2.46 m to resonate at about 1400 rpm. To reduce a packaging size, the section tube may be configured as a spiral shape, to meet the desired length in a reduced packaging space. In one example, if the section tube comprises an inner diameter of 15 mm, then the tube may comprise a 320 mm length within a total packaging space diameter of 70 mm. It will be appreciated that the dimensions of the tube may be adjusted based on an engine size. Additionally or alternatively, as will be desired herein, the tube may be modular and moveable such that the length of the tube may be adjusted based on a current engine operation.

Turning now to FIG. 2, it shows an embodiment 200 of the additional line 7. As such, components previously introduced may be similarly numbered in this figure and subsequent figures.

A valve 202 is arranged between the diaphragm 7*a* and the first junction 8*a*. The valve 202 may be configured to activate the diaphragm 7*a* via allowing exhaust gases to come into face-sharing contact therewith. That is to say, during some engine speeds and/or engine loads, the valve 202 may be opened, which allows exhaust gases to contact and excite with the diaphragm 7*a*, thereby causing the diaphragm to oscillate and create a pressure pulse through the section 7'. Thus, exhaust gases that enter the section 7' through the second junction 8*b* may be excited via the diaphragm, wherein the excited exhaust gas is delivered directly upstream of the turbine and downstream of the particle filter 10*b*. In this way, gases in the section 7' are already treated via the aftertreatment system and do not mix with gases contacting the diaphragm 7*a*. In this way, the second junction 8*b* is the only opening of the section 7'.

In the example of FIG. 2, the section 7' is a spiral tube extending from directly downstream of the diaphragm 7*a* to the second junction 8*b*. In one example, the spiral tube comprises a tuned length in the quarter wave resonance configuration (e.g., sealed at the diaphragm end and open at the second junction end).

In one example, the section 7' may be configured to adjust its length, wherein the length of the section 7' is measured along a central axis 290 as shown by double headed arrow 292. In one example, the spiral tube may rotate in a first direction about the central axis 290 to increase its length. The spiral tube may rotate in a second direction about the central axis, opposite the first direction, to decrease its length. In some examples, the section 7' may be rotated via an actuator, wherein a controller signal to the actuator to rotate the section 7' in the first direction or the second direction in response to the valve 202 being open and engine conditions such as engine speed and engine load.

Turning now to FIG. 3, a method 300 for amplifying an exhaust pressure based on engine conditions is shown. The method 300 may be executed via instructions stored on a memory of the controller and in conjunction with signals received from sensors of the engine system, with reference to FIG. 1. The controller may employ engine actuators of the engine system to adjust engine operation, according to the method described below.

The method 300 begins at 302, which includes determining one or more operating parameters. The operating parameters may include but are not limited to a manifold vacuum, a throttle position, an engine speed, an engine load, and an air/fuel ratio.

The method 300 may proceed to 304, which includes determining if a low-end torque engine operation is present. In one example, the low-end torque engine operation may include an engine speed within a threshold range or an engine load being less than a threshold load. For example, the threshold range may include engine speeds between 1100-2000 rpm. Additionally or alternatively, the threshold range may include engine speed between 1100-1800 rpm. Additionally or alternatively, the threshold range may include engine speeds between 1100-1500 rpm. In one example, the threshold load is a low load.

If the low-end torque engine operation is not present, then the method 300 proceeds to 306, which includes maintain current operating parameters and not opening the valve to activate the diaphragm.

If the low-end torque engine operation is present, then the method 300 may proceed to 308, which includes opening a resonator system valve. The valve may be moved from a fully closed position to a fully open position to allow engine exhaust gases to contact a diaphragm of the resonator system and create a pulsation therein.

The method 300 may proceed to 310, which includes determining a number of engine cylinders combusting. In some examples, one or more cylinders of the engine may be deactivated to reduce fuel consumption.

The method 300 may proceed to 312, which includes adjusting a length of the spiral tube based on the number of engine cylinders combusting. In one example, the length of the spiral tube may be increased in response to more cylinders combusting. Additionally or alternatively, the length of the spiral tube may be increased in response to fewer cylinders combusting.

FIGS. 1 and 2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, a resonator may be arranged on an exhaust system to provide exhaust gas pressure pulses upstream of a turbine and downstream of an aftertreatment system. The resonator system comprises a membrane, such as a diaphragm, and a quarter wave tube connect to one side of the membrane and to a portion of the exhaust system directly upstream of the turbine. The technical effect of the resonator system is to amplify pressure pulses to enhance boosting performance and thus improved low end torque engine performance.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an exhaust system comprising a turbine downstream of one or more aftertreatment devices relative to a direction of exhaust gas flow; and a resonator system coupled to the exhaust system upstream of the one or more aftertreatment devices at a first junction and downstream of the one or more aftertreatment devices at a second junction;

wherein the resonator system includes a resonator valve arranged between a diaphragm and the first junction and a spiral tube extending from the diaphragm to the second junction.

2. The system of claim 1, wherein the second junction is upstream of the turbine.

3. The system of claim 1, wherein the spiral tube comprises a fixed length based on a number of cylinders in an engine, wherein the engine is fluidly coupled to the exhaust system.

4. The system of claim 1, wherein the spiral tube is rotatable to increase or decrease a length of the spiral tube.

5. The system of claim 4, wherein the length of the spiral tube is adjusted in response to a number of cylinders combusting.

6. An exhaust system, comprising:

a first aftertreatment device arranged upstream of a second aftertreatment device in an exhaust passage relative to a direction of exhaust gas flow;

a turbine arranged downstream of the second aftertreatment device;

a resonator system coupled to the exhaust system at a first junction upstream of the first aftertreatment device and a second junction downstream of the second aftertreatment device and upstream of the turbine, further comprising a diaphragm arranged between the first junction and a spiral tube, wherein the spiral tube extends from the diaphragm to the second junction.

7. The exhaust system of claim 6, further comprising a resonator valve arranged between the first junction and the diaphragm.

8. The exhaust system of claim 6, wherein the diaphragm is impermeable to gas and blocks exhaust gas from entering the spiral tube adjacent to the first junction.

9. The exhaust system of claim 6, wherein the first aftertreatment device is an oxidation catalytic converter.

10. The exhaust system of claim 6, wherein the second aftertreatment device is a particle filter.

11. The exhaust system of claim 6, wherein the spiral tube is displaceable in a telescopic manner.

12. The exhaust system of claim 6, wherein the spiral tube is rotatable about a central axis in a first direction and a second direction opposite the first direction.

13. An exhaust system, comprising:

a first aftertreatment device arranged upstream of a second aftertreatment device in an exhaust passage relative to a direction of exhaust gas flow;

a turbine arranged downstream of the second aftertreatment device;

a resonator system coupled to the exhaust system at a first junction upstream of the first aftertreatment device and a second junction downstream of the second aftertreatment device and upstream of the turbine, further comprising a diaphragm arranged between the first junction and a spiral tube, wherein the spiral tube extends from the diaphragm to the second junction, further comprising a resonator valve arranged between the diaphragm and the first junction; and a controller with computer-readable instructions stored on non-transitory memory thereof that when executed enable the controller to:

adjust the resonator valve to an open position in response to an engine speed of an engine being within a threshold range; and adjust the resonator valve to a closed position in response to the engine speed being outside of the threshold range.

14. The exhaust system of claim 13, wherein the diaphragm blocks exhaust gas flow therethrough, and wherein the spiral tube is fluidly coupled to the exhaust system at the second junction.

15. The exhaust system of claim 13, wherein the open position permits exhaust gases to flow through the resonator valve and contact the diaphragm.

16. The exhaust system of claim 15, wherein exhaust gases flowing through the resonator valve do not mix with exhaust gases in the spiral tube.

17. The exhaust system of claim 13, wherein the second junction is the only opening of the spiral tube.

18. The exhaust system of claim 13, wherein the resonator system is a quarter wave resonator system.

* * * * *